United States Patent [19]

Rosenstock

[11] 4,212,555

[45] Jul. 15, 1980

[54] INK ABSORBENT PRESSURE ROLLERS FOR INK RECORDING DEVICES

[75] Inventor: Guenter Rosenstock, Munich, Fed. Rep. of Germany

[73] Assignee: Siemens Aktiengesellschaft, Berlin & Munich, Fed. Rep. of Germany

[21] Appl. No.: 895,958

[22] Filed: Apr. 13, 1978

[30] Foreign Application Priority Data

Apr. 19, 1977 [DE] Fed. Rep. of Germany ... 7712267[U]

[51] Int. Cl.[2] ..... B41J 13/02

[52] U.S. Cl. ..... 400/639.1; 400/126; 400/641; 101/367; 101/416 R; 400/701

[58] Field of Search ..... 400/126, 197, 202.4, 400/639, 639.1, 639.2, 641, 701; 101/367, 416 R

[56] References Cited

U.S. PATENT DOCUMENTS

| | | | |
|---|---|---|---|
| 637,764 | 11/1899 | Campbell | 101/416 R X |
| 651,397 | 6/1900 | Studebaker | 101/416 R X |
| 1,124,309 | 1/1915 | Drake et al. | 101/416 R X |
| 1,143,768 | 6/1915 | Lang | 101/416 R X |
| 1,229,180 | 6/1917 | Kurowski | 400/639.1 |
| 2,007,588 | 7/1935 | Wescott | 101/367 X |
| 2,185,766 | 1/1940 | Higby | 101/416 R |
| 3,336,244 | 8/1967 | Rockoff | 101/367 X |
| 3,491,685 | 1/1970 | Tramposch | 101/367 X |
| 3,923,936 | 12/1975 | Davis et al. | 101/367 X |

*Primary Examiner*—Ernest T. Wright, Jr.

*Attorney, Agent, or Firm*—Hill, Van Santen, Steadman, Chiara & Simpson

[57] ABSTRACT

A pressure roller bar for ink recording devices is disclosed wherein the rollers are formed with ink absorbing surface portions. The roller may have a synthetic body with a circumferential recess receiving a replaceable felt ring which projects radially outwardly of remaining portions of the roller.

5 Claims, 3 Drawing Figures

INK ABSORBENT PRESSURE ROLLERS FOR INK RECORDING DEVICES

BACKGROUND OF THE INVENTION

1. Field of the Invention

This invention relates to ink recording equipment and more particularly to a pressure roller bar for such equipment.

2. Prior Art

Pressure rollers used for pressing a data carrier, such as a sheet of paper, against the platen of a teleprinter or data printer or other ink recording device, are known wherein the pressure rollers are mounted on a hinged pivotable clamp bar, which may be spring biased against the platen. The clamp bar is normally positioned behind the printing position in the direction of feed flow of the paper.

In that type of ink recording device where the recording fluid is applied to the paper in a drop-like form from a recording head such as a jet ink recorder, special inks are used. Normally the inks are chosen such that they do not air dry so that they strike the recording carrier in a liquid state. In order to insure this, hygroscopic additives are provided which supplement those components of the recording fluid or ink which would otherwise evaporate due to air absorption.

Recording fluids of this type are designed to become smear resistant on the recording carrier or paper by penetration into the fibers of the paper. This penetration is dependent upon the suction or absorption capability of the paper and complete penetration may take upwardly of one second. During the time period from droplet deposit on the paper to full absorption the printing can be smeared.

It has been known in ink recording devices to use hinge clamps which are equipped with pressure rollers which press the paper against the platen. Such pressure rollers have generally been constructed of rubber. Although clamps of this type, and their associated pressure rollers, are generally positioned at such a distance from the print position that the ink will be smear resistant by the time it comes into contact with the pressure rollers during normal printing operations, it is possible for smearing to occur if, for example, a continuous line feed is actuated immediately following the application of the last print character. In such instances, it is possible that recording fluid will not yet have been fully absorbed into the paper by the time the paper, under the influence of the continuous line feed, is advanced past the pressure rollers. In such an instance the rollers will pick up some of the ink and return it to the paper on the next revolution of the pressure roller.

It would therefore be an advance in the art to provide a pressure roller which would not take up unabsorbed ink and return it to the recording carrier at a different position.

SUMMARY OF THE INVENTION

It is therefore a principle object of this invention to provide a pressure roller equipped hinge clamp for pressing a data carrier onto a platen in ink recording devices wherein the pressure rollers will not smear recording ink which has not yet been absorbed into the data carrier when the recording ink passes between the platen and the pressure roller and which will not return picked up ink to the data carrier.

This object is achieved according to this invention in that at least those parts of the pressure roller which bear against the data carrier are constructed of an absorbent material which accommodates the recording fluid.

In one particular embodiment of this invention, the parts of the pressure roller which contact the data carrier are ring shaped and may be interchangeable or replaceable. In the disclosed embodiment the material of the recording carrier contacting portions of the pressure rollers is felt.

It is therefore an object of this invention to provide an absorbent pressure roller for use in ink recording apparatus for biasing the recording carrier against a platen.

It is a more particular object of this invention to provide an absorbent pressure roller for use in ink recording apparatus for biasing the recording carrier against a platen wherein the pressure roller is constructed, at least in part, of felt.

It is another, and more specific object of this invention to provide a pressure roller for use in ink recording apparatus wherein the pressure roller is constructed of a synthetic material body rotatably carried on a pressure clamp, the body having a circumferential recess therearound and a felt or other ink absorbent material ring replaceably received in the circumferential recess.

Other objects, features and advantages of the invention will be readily apparent from the following description of a preferred embodiment thereof, taken in conjunction with the accompanying drawing, although variations and modifications may be effected without departing from the spirit and scope of the novel concepts of the disclosure and in which:

DESCRIPTION OF THE PREFERRED EMBODIMENT

Figure 1:
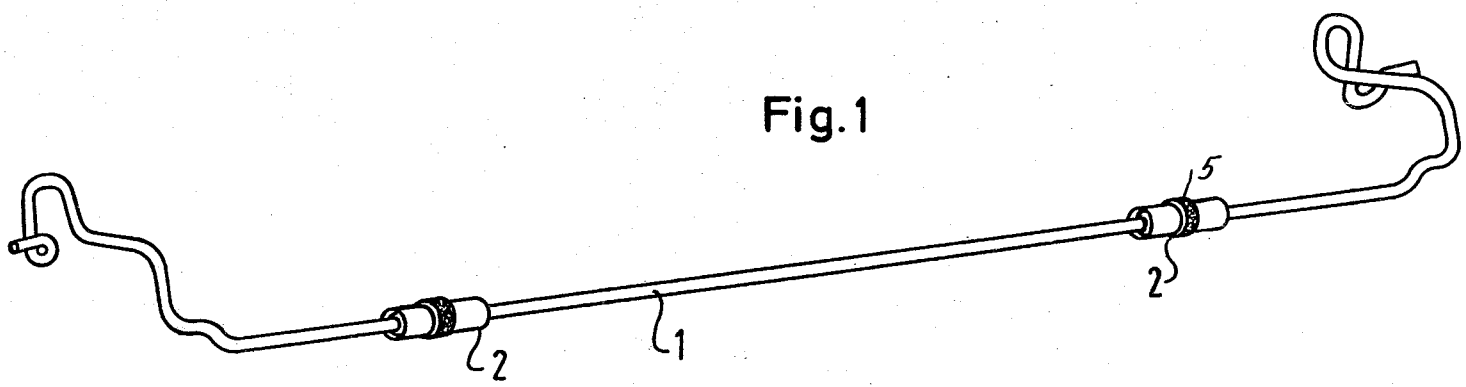
FIG. 1 is a perspective view of a pressure clamp equipped with pressure rollers according to this invention.

According to this invention an ink recording device, such as a jet ink printer 10, is equipped with a hinged clamp 1 which may be spring biased by a spring 11 towards a platen 12. The clamp 1 is provided with spaced apart rotatable pressure rollers 2. The pressure rollers 2 may be attached to the clamp 1 so as to be moveable longitudinally therealong. The pressure rollers 2, under the bias of the clamp 1 function to press a recording carrier 13, such as a paper sheet, against a platen 12 of the ink recording device 10.

Figure 2:
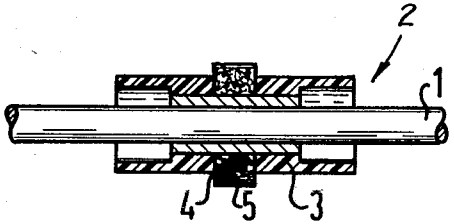
FIG. 2 is an enlarged partially sectional view of the clamp of FIG. 1 illustrating a preferred embodiment of a pressure roller.
Figure 3:
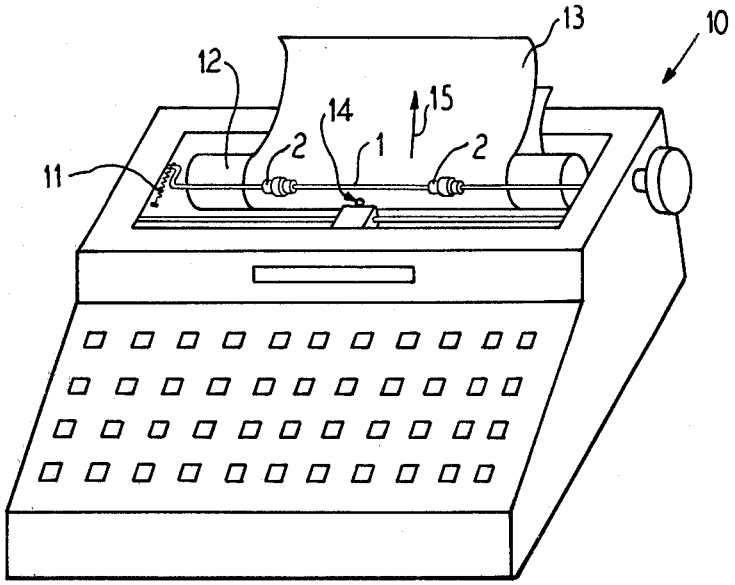
FIG. 3 is a perspective view of an ink recording device equipped with the pressure rollers of this invention.

As best illustrated in FIG. 2, the pressure roller 2 may have a primary body constructed of a synthetic material 3 formed around or forming a bearing surface which encircles the circular cross section clamp 1. The synthetic body 3 may be provided with a ring shaped circumferential recess 4. A felt ring 5 is positioned in the recess 4. As illustrated in FIG. 2, the felt ring 5 has an outer diameter greater than the remainder of the body 3.

In this manner, the felt ring 5 contacts the data carrier 13 and prevents any recording fluid which has not been fully absorbed by the data carrier 13 from becoming smeared by the pressure roller 2. The felt rings 5 act to absorb recording fluid which has not yet been fully drawn into the data carrier 13, however the absorbency of the felt ring 5 is such that it will not return excess recording fluid to the data carrier 13. In this manner the data carrier 13 will not become contaminated with returned recording fluid upon a full rotation of the pressure roller 2.

Over extremely long operating periods it may be possible for a felt ring 5 to loose its absorbent properties. In such a circumstance the felt ring 5 can be exchanged by withdrawing it from the recess 4 of the roller 2 and a new felt ring 5 can be inserted in the recess 4.

Although FIG. 2 illustrates use of a synthetic body 3 with a felt ring 5 received in a recess 4, it is also possible to produce the entire pressure roller 2 of felt, or other absorbent materials such as porous rubber, sintered material or hardened foam.

In the above described embodiment, the pressure rollers 2 are described as being mounted on a hinged paper holding clamp 1 positioned behind the recording position 14 in the direction 15 of feed flow of the data carrier 13. However, of course, pressure rollers constructed according to this invention can also be positioned below the platen 12 in the direction 15 of paper feed. Such a construction can be particularly advantageous when the ink recording apparatus is such that the data carrier 13 can be transported both forward and backward past the print position 14.

It can therefore be seen from the above that this invention provides an ink absorbent pressure roller for use in ink recording apparatus where the pressure roller is provided with an absorbent data carrier contacting surface portion which will take up un-absorbed recording ink without returning it to the data carrier upon a full rotation of the pressure roller.

Although the teachings of my invention have herein been discussed with reference to specific theories and embodiments, it is to be understood that these are by way of illustration only and that others may wish to utilize my invention in different designs or applications.

I claim as my invention:

1. In a liquid jet ink recording apparatus utilizing a data carrier advanced past a platen with a hinged biased clamp member carried by the apparatus equipped with pressure rollers for biasing the data carrier against the platen downstream of a recording position, the improvement of anti-smear means including at least the part of the pressure rollers contacting the data carrier being constructed of an absorbent material, the absorbent material being capable of absorbing liquid recording ink from the surface of the data carrier to minimize smear, the pressure rollers rotatably affixed to the clamp member and having a total length less than a width of the data carrier, the pressure rollers including a body rotatably mounted on the clamp member, the body carrying a movable ring of ink absorbent material having an outer diameter greater than an outer diameter of the body and of the clamp member whereby liquid ink on the data carrier not absorbed by the data carrier at a contact position in contact with the pressure rollers will be at least partially absorbed by the ring on the rotatable bodies thereby reducing smear.

2. A device according to claim 1 wherein the absorbent material is felt.

3. A device according to claim 1 wherein the absorbent material is porous rubber.

4. A device according to claim 1 wherein the absorbent material is sintered material.

5. A device according to claim 1 wherein the absorbent material is a hardened foam.

* * * * *